United States Patent [19]

Dietrich et al.

[11] 4,149,292

[45] Apr. 17, 1979

[54] AUTOMATIC MACHINE FOR WASHING OPEN CONTAINERS

[75] Inventors: Frédéric Dietrich; Georges Chavaillaz, both of Suisse, Switzerland

[73] Assignee: Ferchim Engineering S.A., Switzerland

[21] Appl. No.: 913,665

[22] Filed: Jun. 8, 1978

[30] Foreign Application Priority Data

Nov. 11, 1977 [CH] Switzerland ..... 13771/77

[51] Int. Cl.[2] ..... A46B 13/02

[52] U.S. Cl. ..... 15/56; 15/104.1 C

[58] Field of Search ..... 15/56, 57, 58, 71, 101, 15/104.1 C

[56] References Cited

U.S. PATENT DOCUMENTS

| | | | |
|---|---|---|---|
| 2,558,983 | 7/1951 | Roberts | 15/57 |
| 2,911,662 | 11/1959 | Sedgwick | 15/104.1 C |
| 2,963,725 | 12/1960 | Bredtschneider | 15/104.1 C |
| 4,089,080 | 5/1978 | Beer | 15/56 |

*Primary Examiner*—Edward L. Roberts

*Attorney, Agent, or Firm*—Robert E. Burns; Emmanuel J. Lobato; Bruce L. Adams

[57] ABSTRACT

This machine for washing containers of all open types is adapted to be enclosed in a compartment and comprises a tray to which the container is detachably secured; the tray is pivoted to a frame trunnioned in turn to fixed bracket bearings; a rotary brush connected to a supply of cleaning liquid is adapted, when the container is tilted to a position in which its bottom facing the rotary brush tip is somewhat higher than its opening and the tray is rotatably driven by a peripheral roller, to engage the bottom and inner side faces of the container. The brush and cleaning liquid supply means are responsive to cylinder means so arranged that the machine can accomodate a wide range of container sizes and shapes.

3 Claims, 2 Drawing Figures

AUTOMATIC MACHINE FOR WASHING OPEN CONTAINERS

FIELD OF THE INVENTION

The present invention relates in general to washers and is concerned more particularly with a machine for washing open containers by means of rotary brushes and liquid jets, within a compartment. Machines of this character are intended mainly for use in the chemical, food and similar industries, such as paints and varnishes, dyes, inks, cosmetics, pastes, chocolate, and the like, in which a relatively large number of vessels or containers are utilized in the production lines.

BRIEF DESCRIPTION OF THE PRIOR ART

Machines designed for washing containers by means of rotary brushes mounted on a lazy-tongs device are already known in the art, by their use is restricted to containers having well-defined shapes and dimensions.

There is a considerable demand for a machine capable of washing a wide range of containers, varying not only in shape but also in size, with the requirement that this machine can be operated easily and rapidly.

SUMMARY OF THE INVENTION

The present invention is directed to solve the problem set forth hereinabove by providing a machine for washing containers which is disposed in a compartment and characterized in that it comprises on the one hand a rotary tray to which the container to be washed is secured vertically, said tray being pivoted to a frame structure mounted in turn on trunnions and responsive to a fluid-actuated cylinder so that the frame can be tilted until the geometric axis of the container oversteps the horizontal so that the aperture of the container is at a lower level than its bottom, whereby in this position the circular edge of said tray engages a driving roller, and on the other hand at least one rotary brush having its axis substantially parallel to a generatrix of the container, which is associated with a supply of wash liquid and connected to another fluid-actuated cylinder capable of imparting a reciprocating motion to said brush in a direction substantially parallel to the container axis, said brush being pivotally mounted so that radial movements of translation can be imparted thereto.

DESCRIPTION OF THE PREFERRED EMBODIMENT

Figure 1:
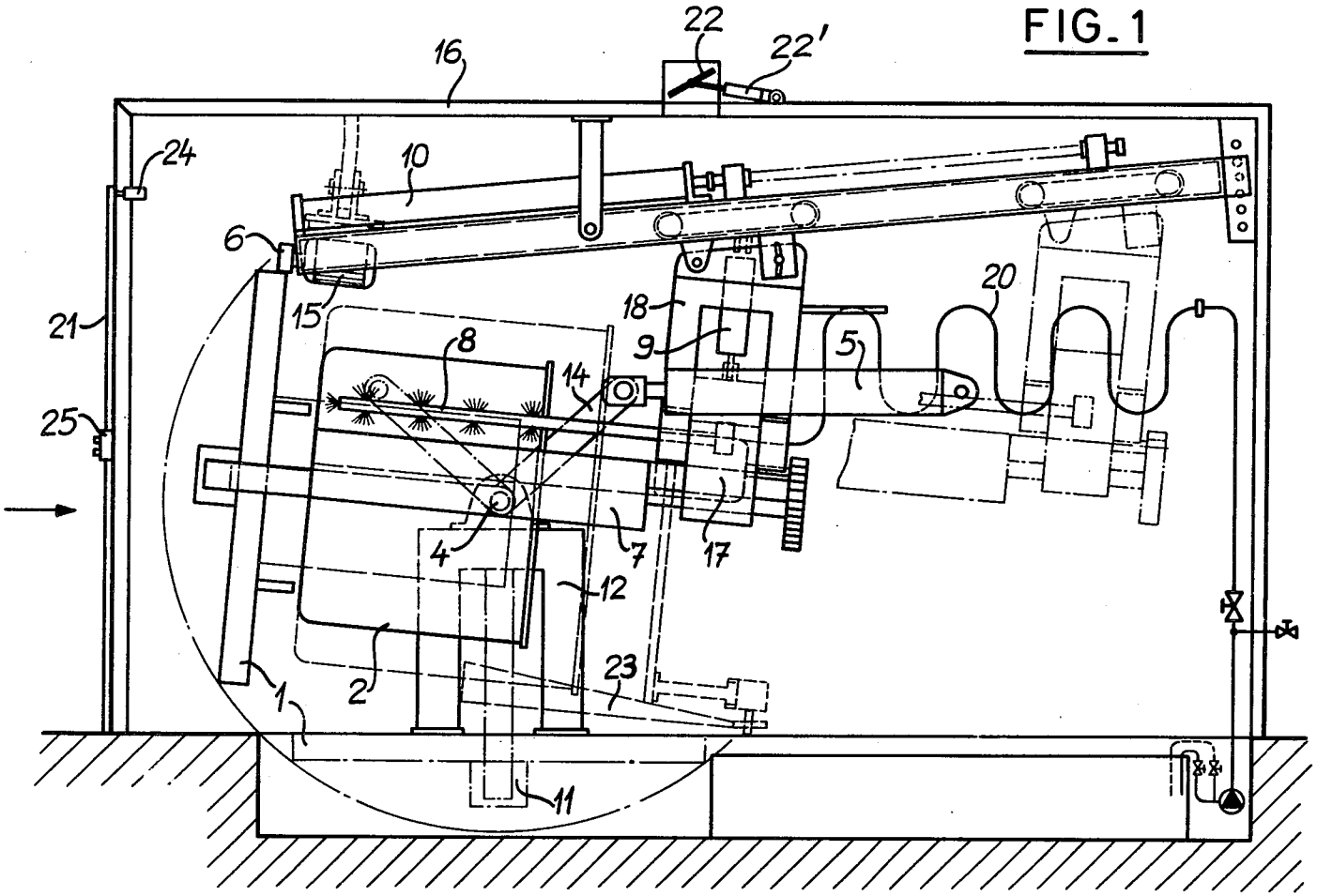
FIG. 1 is a diagrammatic longitudinal section illustrating a preferred form of embodiment of the washing machine according to this invention.

The container washing machine illustrated in the drawing comprises a rotary tray 1 pivotally mounted at 11 on a frame structure 3 supported in turn by trunnions 4 carried by bracket bearings 12. The rotary tray 1 is provided with means 13 for clamping the container 2 to be washed. The frame structure 3 is coupled on either side via crank arms 14 to a fluid-actuated cylinder 5 capable of tilting the assembly to the position shown in phantom lines in FIG. 1. In this tilted position the circular edge of tray 1 engages a rubber-lined driving roller 6 powered by a hydraulic motor 15 secured to the ceiling of compartment 16.

Figure 2:
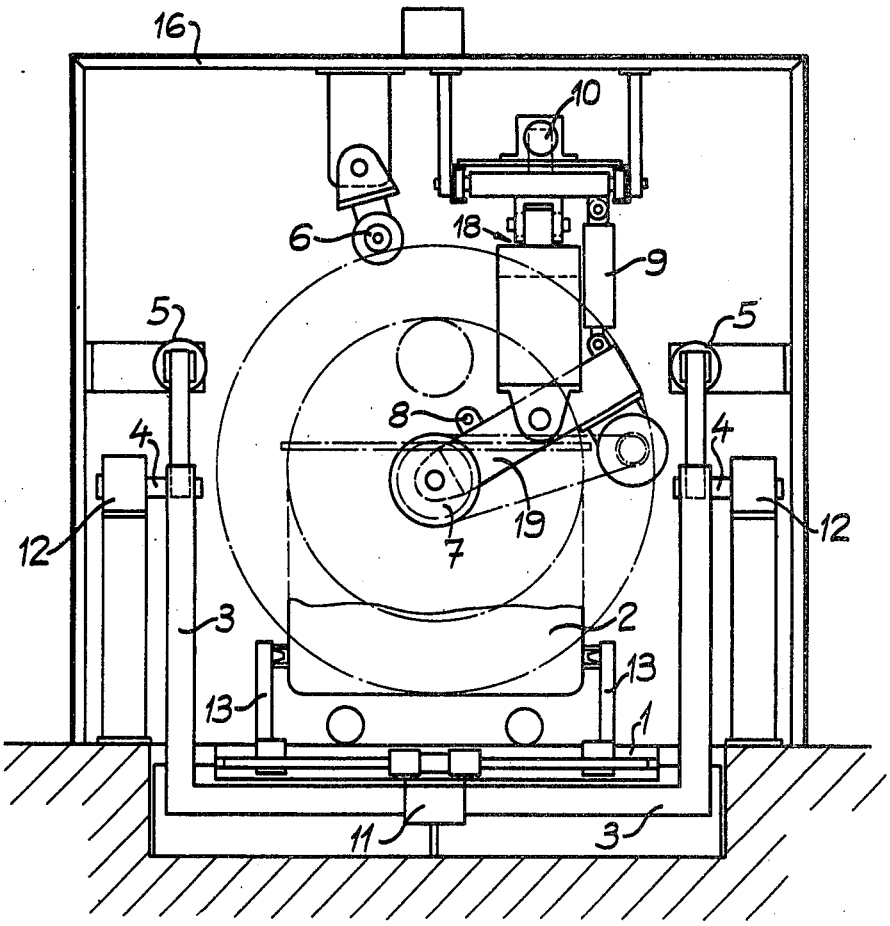
FIG. 2 is a diagrammatic cross-sectional view of the machine shown in FIG. 1.

In the center of FIG. 2 there is shown a rotary brush 7 mounted in an outboard bearing and driven by a motor 17, the latter being preferably hydraulic, though an electric motor may also be used, and if desired the brush and the motor may have a common shaft. The brush 7 is carried by a swing arm 19 connected via a suspension member 18 to the cylinder 10. A small lateral cylinder 9 is provided for imparting a lateral movement of translation to the brush, moving same from the center of the bottom of the container and pressing the brush against the side wall thereof.

Parallel to the brush axis is a cleaning-fluid injection tube 8 connected via a flexible hose 20 to a supply of cleaning and rinsing liquid under pressure (not shown).

The compartment or housing 16 is provided with a front door 21, a valve 22 for extracting vapors, if necessary, a spout 23 for collecting the used liquids, and a manual control for modifying the inclination of suspension member 18 according to the taper of the containers to be washed. Of course, the door 21 is provided with safety lock means 24 and a washing cycle cannot be started by actuating the control means 25 unless the door is properly closed.

The various operations of the cleaning cycle are programmed and take place automatically.

OPERATION

The container 2 to be cleaned is placed upon the tray 1 and held thereon by means of the clamping devices 13. The lock 24 prevents the machine from being started until the door 21 of the washing compartment is closed.

When all preliminary starting requirements are meet, the operator can start the machine by depressing the control pushbutton 25 and the washing cycle is established and takes place as follows:

The solvent vapor extraction valve 22 is closed under the control of a pneumatic cylinder 22';

The tray 1 is caused to tilt under the control of cylinder 5;

The brush 7 responsive to cylinder 10 is caused to engage the bottom of the container;

The motors 17,15 controlling the brush 7 and the rotational movement of tray 1, respectively, and the detergent fluid injection pump (not shown) are started; however, this last-mentioned pump operates during predetermined variable time lapses adjustable by delay-action means (not shown) well known in the art;

due to the action of cylinder 9, the brush 7 accomplishes a radial movement of translation until it engages the generatrix, i.e. the wall, of the container to be cleaned. At the beginning of this operation and during a few seconds this radial movement is repeated in a to-and-fro fashion in order properly to clean the surface of the container bottom;

at the end of the brushing period, suitable automatic valves are actuated to inject a rinsing product. The spout 23 provided with a hinged opening collects the used products and these are directed into a recovery vessel (not shown);

at the end of the cycle, the motors are stopped, the solvent vapor extraction valve 22 is opened, the brushing members are returned to their initial positions and the tray 1 is also tilted back to its initial position;

finally, the clean container is extracted from the machine.

The injection of a proper cleaning product, in combination with the mechanical action exerted by a rotary brush driven under a predetermined pressure in a direction opposite to the direction of rotation of the container to be washed, imparts to the machine according to this invention a maximum cleaning capacity, even under the most unfavorable conditions.

Of course, the cleaning liquid to be injected is selected as a function of the product previously kept in the container.

The original arrangement of the various component elements of the machine is such that changing from one cleaning product to another is easily done when required.

The machine can clean containers of all shapes, whether cylindrical, oval, parallelipipedic (square-sectioned, rectangular-sectioned, etc.), tapered or not.

Whatever the position of the container bottom in relation to the floor, it is the brushing member, operating on an inclined axis, that engages the surface to be cleaned.

With only two machine sizes it is possible to wash containers having a diameter of 250 to 1,300 millimeters and a depth of 700 to 1,300 mm, thus covering a complete range of the containers, vessels or barrels commonly utilized in most industries.

Of course, specific adaptations, modifications and changes may be brought to the preferred form of embodiment of the invention which is described and illustrated herein without departing from the basic principle of the invention.

Furthermore, the machine according to this invention can easily be adapted to meet official regulations in force in each Country in connection with the use of equipment in rooms where an explosion hazard exists.

The washing machine according to this invention, when completed if necessary with means for processing solvent vapors, for example by adsorption on activated carbon, and for the continuous distillation of washing solvents, constitutes a complete, self-contained industrial equipment complying with ecological protection rules.

What is claimed is:

1. A machine for washing open containers by means of a rotary brush and liquid jets, disposed in a compartment and comprising on the one hand a rotary tray and a frame structure, means for securing in a vertical position the container to be washed, means for pivotally mounting said tray to said frame, said frame being mouned in turn by means of trunnions, fluid-actuated cylinder means for tilting said tray until the axis of the container secured thereto has overstepped the horizontal so that the container opening is at a level somewhat lower than that of the container bottom, a motor-driven roller positioned to engage and drive said tray in said tilted position, and on the other hand at least one motor-driven rotary brush having its axis substantially parallel to the generatrix of said container, cleaning fluid supply and jet means associated with said rotary brush, said rotary brush being connected to another fluid-actuated cylinder capable of imparting a reciprocating motion thereto in a direction substantially parallel to the container axis, said rotary brush being pivotally mounted so that it can perform radial movements of translation.

2. A washing machine according to claim 1, wherein other reciprocating motion cylinder is secured to the ceiling of said compartment with an inclination opposite to that of said container, whereby the piston of said other cylinder can cause said rotary brush to penetrate by gravity the cavity of said container to the bottom thereof.

3. A washing machine according to claim 1, wherein a third fluid-actuated cylinder is provided for imparting said radial movements of translation to said rotary brush.

* * * * *